US007585060B2

(12) United States Patent
Kanaya

(10) Patent No.: US 7,585,060 B2
(45) Date of Patent: Sep. 8, 2009

(54) LIQUID EJECTING HEAD AND LIQUID EJECTING APPARATUS

(75) Inventor: Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

(21) Appl. No.: 11/761,214

(22) Filed: Jun. 11, 2007

(65) Prior Publication Data

US 2007/0285470 A1 Dec. 13, 2007

(30) Foreign Application Priority Data

Jun. 12, 2006 (JP) ..... 2006-162763

(51) Int. Cl.
*B41J 2/045* (2006.01)

(52) U.S. Cl. ..... 347/68

(58) Field of Classification Search ..... 347/68, 347/69–72; 400/124.16
See application file for complete search history.

(56) References Cited

U.S. PATENT DOCUMENTS 6,378,996 B1 * 4/2002 Shimada et al. ..... 347/70
7,527,356 B2 * 5/2009 Sato ..... 347/68
2004/0085410 A1 * 5/2004 Miyata ..... 347/68

FOREIGN PATENT DOCUMENTS

| | | |
|---|---|---|
| JP | 09-226115 | 9/1997 |
| JP | 2003-159800 | 6/2003 |
| JP | 2004-034293 | 2/2004 |
| JP | 2004-228393 | 8/2004 |
| JP | 2005-203657 | 7/2005 |
| JP | 2006-116767 | 5/2006 |

* cited by examiner

*Primary Examiner*—K. Feggins
(74) *Attorney, Agent, or Firm*—Workman Nydegger

(57) ABSTRACT

A liquid ejecting head includes a passage-forming substrate, a plurality of pressure-generating elements, and an IC chip. The passage-forming substrate has a nozzle opening, and a pressure-generating chamber communicating with the nozzle opening. The plurality of pressure-generating elements are provided on a surface of the passage-forming substrate with a diaphragm interposed therebetween. The pressure-generating elements have electrodes and cause pressure change in the pressure-generating chamber. The IC chip is mounted on the surface of the passage-forming substrate with the pressure-generating elements. In this liquid ejecting head, the electrodes of the pressure-generating elements include individual electrodes, and at least the individual electrodes are electrically connected to the driver circuit via the through electrode.

7 Claims, 5 Drawing Sheets

LIQUID EJECTING HEAD AND LIQUID EJECTING APPARATUS

The entire disclosure of Japanese Patent Application No, 2006-162763, filed Jun. 12, 2006 is expressly incorporated by reference herein.

BACKGROUND

1. Technical Field

The present invention generally relates to liquid ejecting heads and liquid ejecting apparatuses, and more particularly, it relates to an ink jet recording head and an ink jet recording apparatus in which a portion of a pressure-generating chamber communicating with a nozzle opening that ejects an ink droplet is constituted by a diaphragm, a piezoelectric element is provided on a surface of the diaphragm, and the ink droplet is ejected by displacement of the piezoelectric element.

2. Related Art

A typical ink jet recording head has a configuration in which a portion of a pressure-generating chamber communicating with a nozzle opening that ejects an ink droplet is constituted by a diaphragm, the diaphragm is deformed by a piezoelectric element to apply a pressure to ink provided in the pressure-generating chamber, so that the ink is ejected from a nozzle opening as an ink droplet. For example, the ink jet recording head uses a piezoelectric actuator of flexural vibration mode.

Such an ink jet recording head includes a passage-forming substrate having an array of pressure-generating chambers communicating with nozzle openings, a joint substrate bonded to a surface of the passage-forming substrate with piezoelectric elements, and a driver IC mounted on a wiring pattern provided at the joint substrate, for driving the piezoelectric elements. The driver IC and the wiring pattern are electrically connected by wire bonding, and also the driver IC and lead wires extending from the piezoelectric elements are electrically connected by wire bonding (for example, see JP-A-2004-034293).

With this ink jet recording head of the related art, since wires of the wiring pattern on which the driver IC is mounted are arranged at high density, the wiring pattern is necessary to be highly accurately patterned. This may increase manufacturing cost, and cause the adjacent wires to short-circuit, resulting in occurrence of defective connection. In addition, since the driver IC and the wiring pattern, as well as the driver IC and the piezoelectric elements are connected by wire bonding, a relatively wide area is necessary for extension of bonding wires. This may cause an increase in size of the head. These problems may be involved not only in the ink jet recording heads that eject ink, but also in other liquid ejecting heads that eject liquid other than ink.

SUMMARY

An advantage of some aspects of the invention is to provide a liquid ejecting head and a liquid ejecting apparatus that allows a driver circuit and a piezoelectric element to be electrically connected easily, thereby reducing manufacturing cost and preventing defective connection from occurring.

According to an aspect of the invention, a liquid ejecting head includes a passage-forming substrate, a plurality of pressure-generating elements, and an IC chip. The passage-forming substrate has a nozzle opening, and a pressure-generating chamber communicating with the nozzle opening. The plurality of pressure-generating elements are provided on a surface of the passage-forming substrate with a diaphragm interposed therebetween. The pressure-generating elements have electrodes and cause pressure change in the pressure-generating chamber. The IC chip is mounted on the surface of the passage-forming substrate with the pressure-generating elements. The IC chip includes a semiconductor substrate, a driver circuit, a first pad, an external wiring pattern, a second pad, and a through electrode. The driver circuit is provided at a surface of the semiconductor substrate. The driver circuit drives the pressure-generating elements. The first pad is provided on a surface of the semiconductor substrate opposite to a surface facing the passage-forming substrate. The first pad is electrically connected to the driver circuit. The external wiring pattern is electrically connected to the first pad. The second pad is provided on the surface of the semiconductor substrate facing the passage-forming substrate. The second pad is electrically connected to the electrodes of the pressure-generating elements. The through electrode penetrates through the semiconductor substrate. The through electrode is connected to the second pad. In this liquid ejecting head, the electrodes of the pressure-generating elements include individual electrodes, and at least the individual electrodes are electrically connected to the driver circuit via the through electrode.

With this configuration, the pressure-generating elements can be electrically connected to the driver circuit via the through electrode relatively easily and reliably. Also, since the wiring structure for the connection between the pressure-generating elements and the driver circuit is simplified, the manufacturing cost can be reduced, and the defective connection can be prevented.

Preferably, in the liquid ejecting head, the IC chip may be arranged such that a plurality of semiconductor substrates are laminated. Each of the semiconductor substrates may have the through electrode penetrating therethrough. Also, the through electrodes of the semiconductor substrates may be connected to one another via an intermediate wiring pattern, the intermediate wiring pattern extending to a joint surface where the adjacent semiconductor substrates are bonded.

With this configuration, the position of an end of the through electrode located at the surface of the IC chip near the external wiring pattern may be different from the position of the other end of the through electrode located at the surface thereof near the passage-forming substrate. Accordingly, the through electrode can be connected to the electrodes of the pressure-generating elements at desired position.

Preferably, the liquid ejecting head may further includes a joint substrate bonded to the surface of the passage-forming substrate with the pressure-generating element. At least one of surfaces of a passage through which liquid is supplied may be constituted by the joint substrate.

With this configuration, the IC chip is mounted on the passage-forming substrate. Accordingly, even when the joint substrate for constituting the passage is bonded on the passage-forming substrate, a conductive adhesive used for mounting the IC chip may not have the ink-resistant characteristic. This may widen the choices of adhesives.

Preferably, in the liquid ejecting head, the passage-forming substrate may have a nozzle plate bonded thereon, the nozzle plate having the nozzle opening made by punching. Also, the passage-forming substrate and the nozzle plate may be made of a silicon single crystal substrate.

With this configuration, the passage-forming substrate and the nozzle plate are made of the silicon single crystal substrate, thereby having the same coefficient of thermal expansion. Accordingly, even when the IC chip is mounted on the passage-forming substrate at a relatively high temperature, the passage-forming substrate and the like would not be deformed.

Preferably, in the liquid ejecting head, the through electrode may be connected to lead electrodes extending from the electrodes of the pressure-generating elements.

With this configuration, the IC chip can be mounted on the passage-forming substrate relatively easily, and the driver circuit can be electrically connected to the pressure-generating elements further reliably.

Preferably, in the liquid ejecting head, the electrodes of the pressure-generating elements may include common electrodes. The lead electrodes may include common lead electrodes and individual lead electrodes, the common lead electrodes extending from the common electrodes of the pressure-generating elements, the individual lead electrodes extending from the individual electrodes of the pressure-generating elements. Also, the common lead electrodes and the individual lead electrodes may be located at the same height in a region where the common lead electrodes and the individual lead electrodes are connected to the driver circuit.

With this configuration, the connection surface between the individual lead electrodes and the driver circuit, and the connection surface between the common lead electrodes and the driver circuit become arranged at the same plane. Accordingly, the driver circuit can be connected to the individual and common lead electrodes without rattling.

According to another aspect of the invention, a liquid ejecting apparatus includes the above-described liquid ejecting head.

With this configuration, a liquid ejecting apparatus can be provided that is capable of promoting the reduction in size of the head, and enhancing the reliability of the head.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention is described below in detail according to embodiments.

First Embodiment

Figure 1:
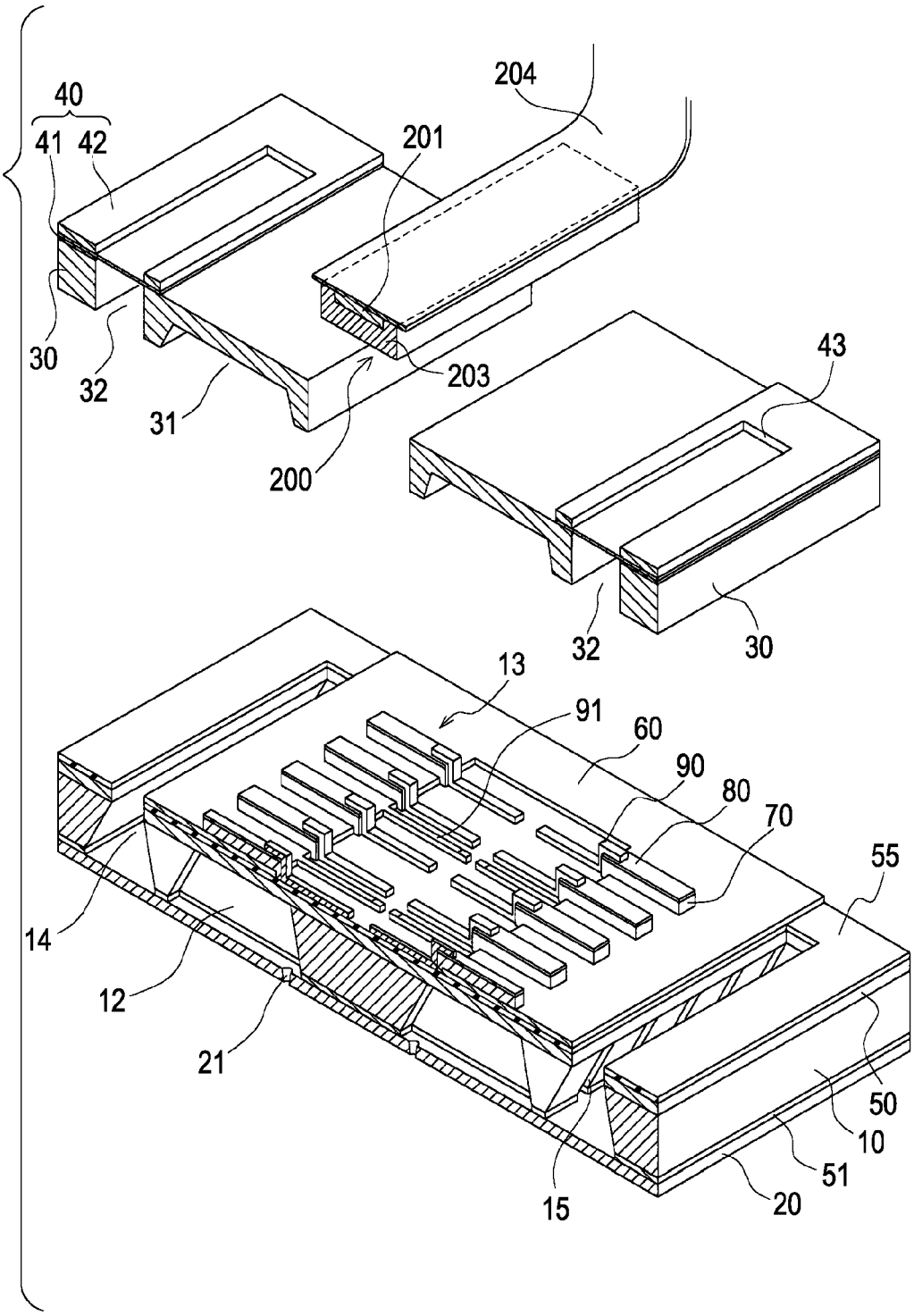
FIG. 1 is an exploded perspective view showing a recording head according to a first embodiment.
Figure 2A:
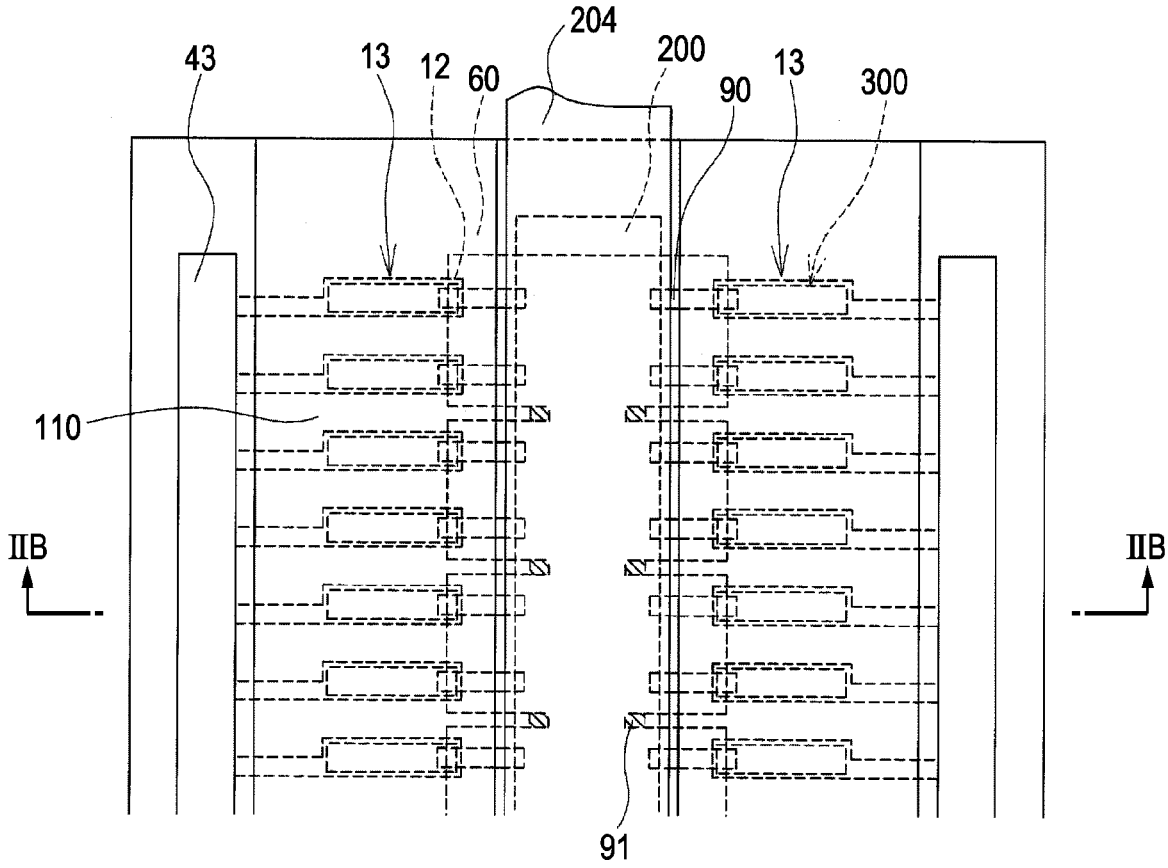
FIG. 2A is a plan view showing the recording head according to the first embodiment.
Figure 2B:
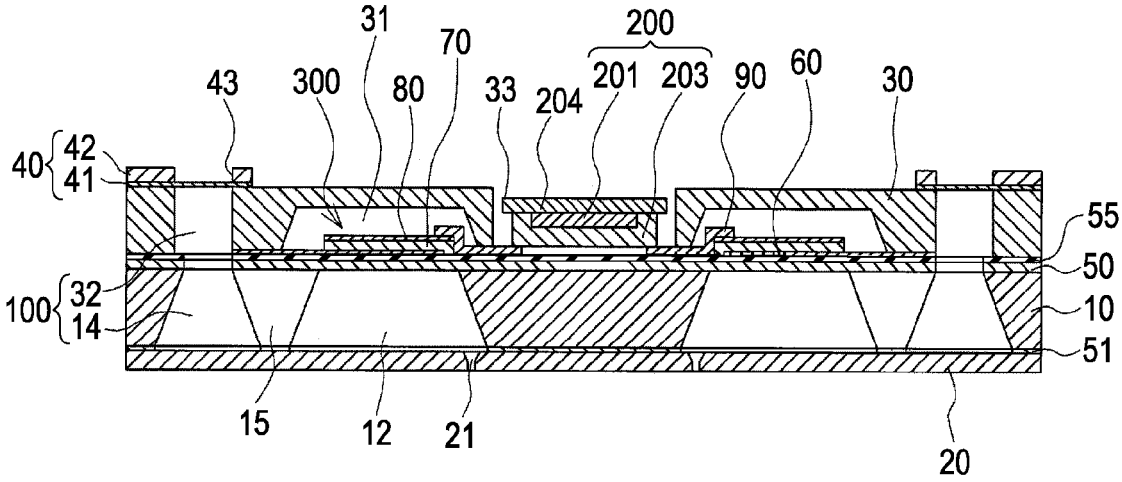
FIG. 2B is a cross-sectional view showing the recording head according to the first embodiment.

FIG. 1 is an exploded perspective view showing an ink jet recording head which is an example of a liquid ejecting head according to a first embodiment of the invention. FIGS. 2A and 2B are a plan view and a cross-sectional view of FIG. 1. As shown in the drawings, a passage-forming substrate 10 is made of a silicon single crystal substrate arranged along a plane (110) in this embodiment. An elastic film 50 is previously formed on one surface of the passage-forming substrate 10. The elastic film 50 has a thickness ranging from 0.5 to 2 μm and made of silicon dioxide by thermal oxidization. A plurality of pressure-generating chambers 12 are aligned in a width direction of the passage-forming substrate 10 to form an array 13. Here, two arrays 13 are provided at the passage-forming substrate 10. Communicating portions 14 are provided in regions of the passage-forming substrate 10 at outer sides in a longitudinal direction of the arrays 13 of the pressure-generating chambers 12. The communicating portions 14 communicate with the pressure-generating chambers 12 through ink supply passages 15 that are respectively provided at the pressure-generating chambers 12. The communicating portions 14 communicate with reserving portions of protection substrates (described below) and serve as a portion of a reservoir that is a common ink chamber for the pressure-generating chambers 12. The ink supply passages 15 has a width smaller than that of the pressure-generating chambers 12, and hold the flow resistance of ink (an example of liquid) constant, the ink flowing from the communicating portions 14 to the pressure-generating chambers 12.

An insulating film 51 is provided at an open side of the passage-forming substrate 10, and a nozzle plate 20 is fixed to the insulating film 51 with an adhesive, a hot welding film, or the like, interposed therebetween. The insulating film 51 has been used as a mask when forming the pressure-generating chambers 12. The nozzle plate 20 has nozzle openings 21 formed by punching, each nozzle opening 21 communicating with the pressure-generating chamber 12 at an end opposite to the ink supply passage 15. The material of the nozzle plate 20 may be, for instance, glass ceramic, a silicon single crystal substrate, or stainless steel. In particular, a silicon single crystal substrate is preferably used because it is the material of the passage-forming substrate 10.

On a side opposite to the open side of the passage-forming substrate 10, the elastic film 50 with a thickness of about 1.0 μm is formed as described above, and an insulating film 55 with a thickness of about 0.4 μm is formed on the elastic film 50. Also, piezoelectric elements 300 are provided on the insulating film 55. Each piezoelectric element 300 includes a bottom electrode film 60 with a thickness of about 0.2 μm, a piezoelectric material layer 70 with a thickness of about 1.0 μm, and a top electrode film 80 with a thickness of about 0.05 μm. Note that the piezoelectric element 300 (an example of the pressure-generating element) is a portion including the bottom electrode film 60, the piezoelectric material layer 70, and the top electrode film 80. In general, one of the electrodes of the piezoelectric element 300 serves as a common electrode, and the residual electrode and the piezoelectric material layer 70 are patterned corresponding to each pressure-generating chamber 12. In this embodiment, the bottom electrode film 60 serves as a common electrode of the piezoelectric element 300, and the top electrode film 80 serves as an individual electrode of the piezoelectric element 300. Alternatively, these arrangement may be reversed depending on the arrangement of a driving circuit and wiring. In this embodiment, the elastic film 50, the insulating film 55 and the bottom electrode film 60 define a diaphragm. Alternatively, the elastic film 50 and the insulating film 55 may not be provided and only the bottom electrode film 60 may serve as a diaphragm.

Lead electrodes are connected to the electrodes of the piezoelectric elements 300. In particular, individual lead electrodes 90, for example, made of gold (Au), are connected to the top electrode films 80 serving as the individual electrodes of the piezoelectric elements 300. The individual lead electrodes 90 extend to a region between the arrays 13 of the pressure-generating chambers 12. A plurality of common lead electrodes 91 extend from the bottom electrode films 60 serving as the common electrodes of the piezoelectric elements 300. For instance, one common lead electrode 91 may be provided every tenth piezoelectric element 300.

Though described below in details, a driver circuit (semiconductor integrated circuit) for driving the piezoelectric elements 300 is electrically connected to tip ends of the individual lead electrodes 90 extending from the piezoelectric elements 300 and on the tip ends of the common lead electrodes 91 extending from the bottom electrode films 60.

A protection substrate 30 is bonded on the passage-forming substrate 10. The protection substrate 30 has a piezoelectric element retainer 31 that is a space for protecting the piezoelectric elements 300. In this embodiment, a plurality of protection substrates 30 are bonded on the passage-forming substrate 10. In particular, one protection substrate 30 may be provided for each array 13 of the piezoelectric elements 300. Each protection substrate 30 has a reserving portion 32 provided at a region corresponding to the communicating portion 14 of the passage-forming substrate 10. In this embodiment, the reserving portion 32 penetrates through the protection substrate 30 in the thickness direction and is disposed along the array 13 of the pressure-generating chambers 12. As mentioned above, the reserving portion 32 communicates with the communicating portion 14 of the passage-forming substrate 10 to define a reservoir 100 that is a common ink chamber for the pressure-generating chambers 12. In other words, the protection substrate 30 defines a portion of an ink passage through which ink is supplied.

The material of such a protection substrate 30 may be glass, a ceramic material, metal, resin, or the like. The protection substrate 30 is preferably made of a material having substantially the same coefficient of thermal expansion as that of the passage-forming substrate 10. In this embodiment, the protection substrate 30 is made of the same material as that of the passage-forming substrate 10, i.e., a silicon single crystal substrate.

A compliant substrate 40 is bonded on the protection substrate 30. The compliant substrate 40 includes a sealing film 41 and a fixing plate 42. The sealing film 41 is made of a flexible material having a low rigidity (for example, a polyphenylene sulfide (PPS) film with a thickness of 6 μm). One surface of the reserving portion 32 is sealed with the sealing film 41. The fixing plate 42 is made of a rigid material like metal, for example, stainless steel (SUS) with a thickness of 30 μm. A region of the fixing plate 42 facing the reservoir 100 is completely removed in the thickness direction to form an opening 43. One surface of the reservoir 100 is sealed only with the flexible sealing film 41.

An IC chip 200 having a driver circuit 201 for driving the piezoelectric elements 300 is mounted on the passage-forming substrate 10 in a region between the protection substrates 30. The above-described individual lead electrodes 90 and common lead electrodes 91 extend to the region between the protection substrates 30. For example, an anisotropic conductive agent, such as an anisotropic conductive film (ACF), anisotropic conductive paste (ACP), a non-conductive film (NCF), or non-conductive paste (NCP) is applied on the individual lead electrodes 90 and the common lead electrodes 91, and the IC chip 200 is mounted thereon. Though described below, through electrodes 202 are provided in the IC chip 200. The driver circuit 201 is connected to the individual lead electrodes 90 and the common lead electrodes 91 via the through electrodes 202. In particular, the top electrode films 80 serving as the individual electrodes of the piezoelectric elements 300 are electrically connected to the driver circuit 201 via the individual lead electrodes 90 and the through electrodes 202. The bottom electrode films 60 serving as the common electrodes of the piezoelectric elements 300 are electrically connected to the driver circuit 201 via the common lead electrodes 91 and the through electrodes 202.

Figure 3:
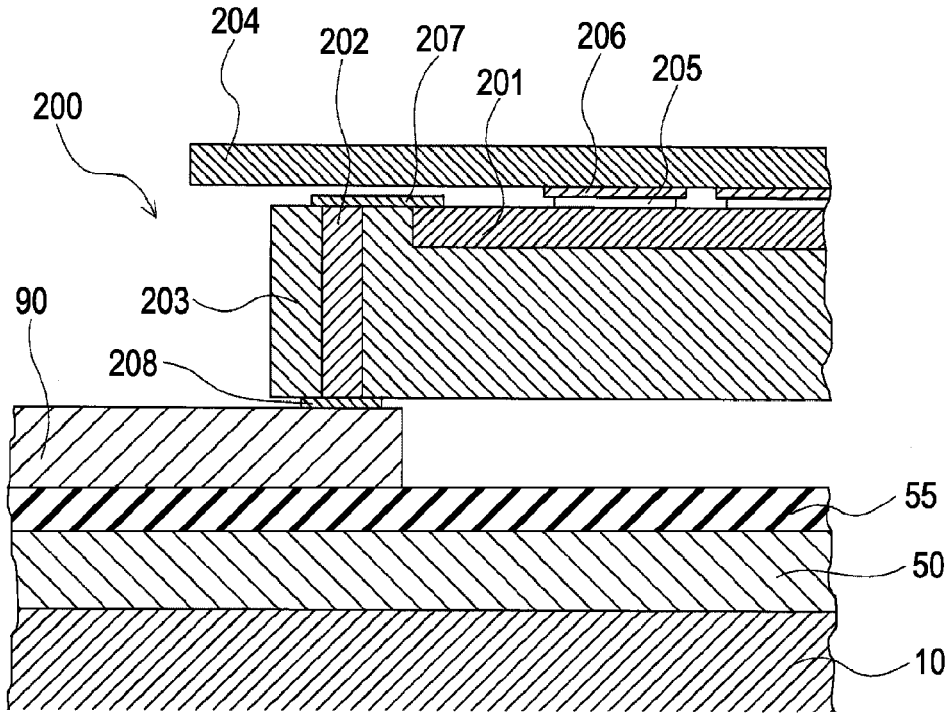
FIG. 3 is an enlarged cross-sectional view showing the recording head according to the first embodiment.

As shown in an enlarged cross-sectional view in FIG. 3, a semiconductor substrate 203 of the IC chip 200 is, for instance, made of a silicon substrate. The driver circuit 201 for driving the piezoelectric elements 300 is disposed on one surface of the semiconductor substrate 203, i.e., on the surface located opposite to a joint surface with respect to the passage-forming substrate 10. An external wiring pattern 204 made of a flexible tape, for example, a chip-on-film (COF) is fixed to one surface of the IC chip 200. First pads 205 connected to the driver circuit 201 are provided on the one surface of the IC chip 200. Wiring lines 206 of the external wiring pattern 204 are connected to the first pads 205.

The top electrode films 80 serving as the individual electrodes of the piezoelectric elements 300 are electrically connected to the driver circuit 201 via the through electrodes 202 provided in the IC chip 200 as described above. The through electrodes 202 penetrate through the IC chip 200 in the thickness direction, and are provided corresponding to the individual lead electrodes 90 and the common lead electrodes 91. Ends of the through electrodes 202 are connected to a connection wiring pattern 207 provided on the surface of the IC chip 200 (i.e., a surface to which the external wiring pattern 204 is fixed) and are electrically connected to the driver circuit 201 via the connection wiring pattern 207. The other ends of the through electrodes 202 are connected to second pads 208 provided on the surface of the IC chip 200 at the individual lead electrode 90 side. Tip ends of the individual lead electrodes 90 extending from the top electrode films 80 of the piezoelectric elements 300 are connected to the second pads 208. Although not shown, the through electrodes 202 are also provided at regions corresponding to the common lead electrodes 91 extending from the bottom electrode films 60 serving as the common electrodes of the piezoelectric elements 300. The common lead electrodes 91 are connected to predetermined wiring lines 206 of the external wiring pattern 204 via the through electrodes 202. For instance, one common lead electrodes 91 may be provided every second nozzle or tenth nozzle within a range not causing cross talk.

In this embodiment, as described above, the through electrodes 202 are provided in the semiconductor substrate 203 of the IC chip 200. Also, the second pads 208 to which the individual lead electrodes 90 and the common lead electrodes 91 are connected are provided on the surface thereof located opposite to the surface to which the external wiring pattern 204 is fixed. That is, the top electrode films 80 and the bottom electrode films 60 of the piezoelectric elements 300 are electrically connected to the driver circuit 201 via the through electrodes 202.

Accordingly, the wiring structure for electrically connecting the driver circuit 201 and the electrodes of the piezoelectric elements 300 (the bottom electrode films 60 and the top electrode films 80) can be simplified. Therefore, it is not necessary to provide wiring lines for mounting the IC chip 200 on the passage-forming substrate 10. Generally, high current is supplied to the bottom electrode films 60 when all nozzles are driven. Since at least one wiring line is connected to the bottom electrode films 60 from the external wiring pattern 204 having a relatively small resistance, the bottom electrode films 60 may become thin and accurate, and the bottom electrode films 60 do not disturb displacement of the head, thereby improving displacement characteristic. This may promote reduction in size of the head and its manufacturing cost.

The individual lead electrodes 90 extending from the top electrode films 80 and the common lead electrodes 91 extending from the bottom electrode films 60 may be preferably arranged at the same height in a region where these electrodes 90 and 91 are connected to the driver circuit 201, i.e., in a region where these electrodes 90 and 91 are connected to the second pads 208. When the height (thickness) of the common lead electrodes 91 extending from the bottom electrode films 60 are lower (smaller) than that of the individual lead electrodes 90 extending from the top electrode films 80, pads for adjusting the height are provided at the region where the common lead electrodes 91 are connected to the driver circuit. With this configuration, the driver circuit can be connected to the individual lead electrodes 90 and the common lead electrodes 91 without rattling.

In this embodiment, the nozzle plate 20 is made of a silicon single crystal substrate which is the same material as that of the passage-forming substrate 10. Accordingly, the mounting temperature of the IC chip 200 can be relatively high such as about 150° C. In particular, the coefficient of linear expansion of the passage-forming substrate 10 is the same as that of the nozzle plate 20. Even when the mounting temperature of the IC chip 200 is relatively high, the IC chip 200 can be mounted reliably without deformation occurring in the passage-forming substrate 10 and the like.

In this embodiment, the IC chip 200 is mounted on the passage-forming substrate 10, and the protection substrate 30, which is a joint substrate having the reserving portion 32 to form the ink passage, is bonded. When the protection substrate 30 is bonded to the passage-forming substrate 10, an adhesive having ink-resistant characteristic (liquid-resistant characteristic) is necessary to be used. For example, if the IC chip is mounted on the protection substrate, an adhesive for connecting and fixing the IC chip also needs to have the ink-resistant characteristic. That is, a method of connecting the IC chip is limited. However, since the IC chip 200 is mounted on the passage-forming substrate 10 as described in this embodiment, the adhesive (anisotropic conductive agent) may not have the ink-resistant characteristic. This may widen the choices of adhesives. In other words, this may widen the choices of methods of connecting the IC chip.

With the ink jet recording head of the above-described embodiment, an external ink supplying unit (not shown) supplies ink, the passage from the reservoir 100 to the nozzle openings 21 is filled with the ink, then a voltage is applied between the bottom electrode films 60 and the top electrode films 80 corresponding to the pressure-generating chambers 12 in accordance with a recording signal sent from the driver circuit 201, and consequently the elastic film 50, the insulating film 55, the bottom electrode film 60 and the piezoelectric material layer 70 are bent. Accordingly, the pressure in the pressure-generating chambers 12 increases and ink droplets are ejected from the nozzle openings 21.

Second Embodiment

Figure 4:
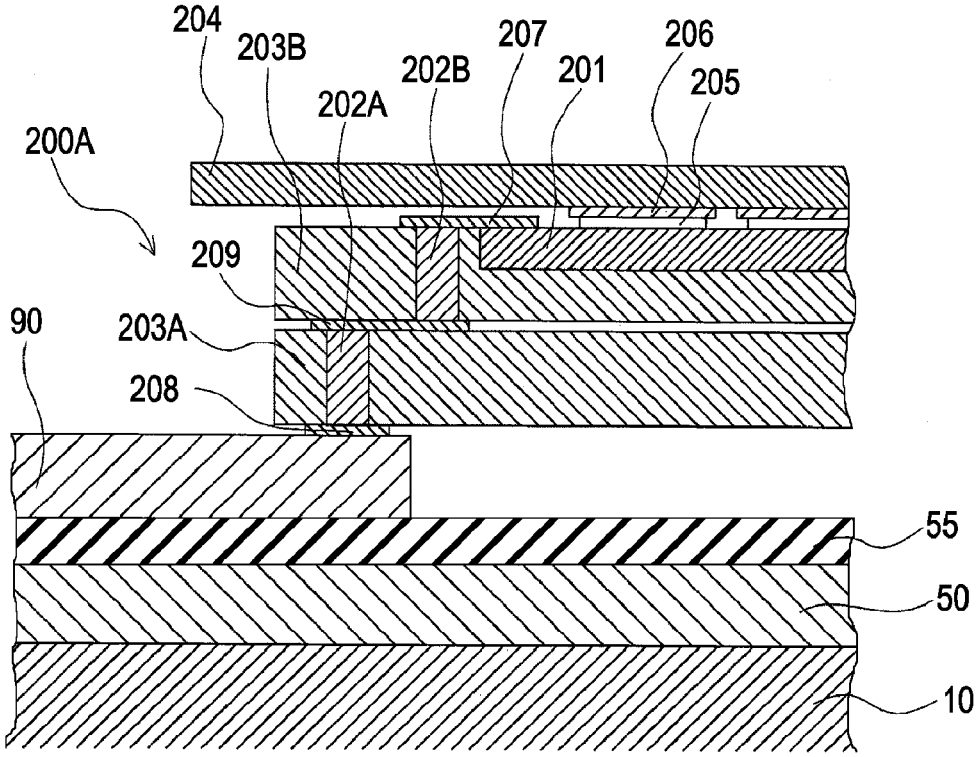
FIG. 4 is an enlarged cross-sectional view showing a recording head according to a second embodiment.

FIG. 4 is an enlarged cross-sectional view showing the overview of the ink jet recording head according to a second embodiment. This embodiment is a modification of the IC chip 200, and other components are similar to those of the first embodiment. In particular, as shown in FIG. 4, an IC chip 200A of this embodiment includes two laminated semiconductor substrates (a first semiconductor substrate 203A and a second semiconductor substrate 203B). The first and second semiconductor substrates 203A and 203B respectively have first and second through electrodes 202A and 202B. The first through electrodes 202A provided in the first semiconductor substrate 203A are connected to the second through electrodes 202B provided in the second semiconductor substrate 203B, via an intermediate wiring pattern 209 provided between the first and second semiconductor substrates 203A and 203B.

With this configuration, a connection portion where the through electrodes (first through electrodes) are connected to the connection wiring pattern 207, and a connection portion where the second pads 208 of the through electrodes (second through electrodes) are connected to the second pads 208, can be arranged at different positions in a plane direction of the IC chip 200A. In other words, the connection portions of the through electrodes can be relatively easily located at desired positions without extension of wiring lines to the surface of the IC chip 200A. This configuration may provide advantages similar to those of the first embodiment.

Figure 5:
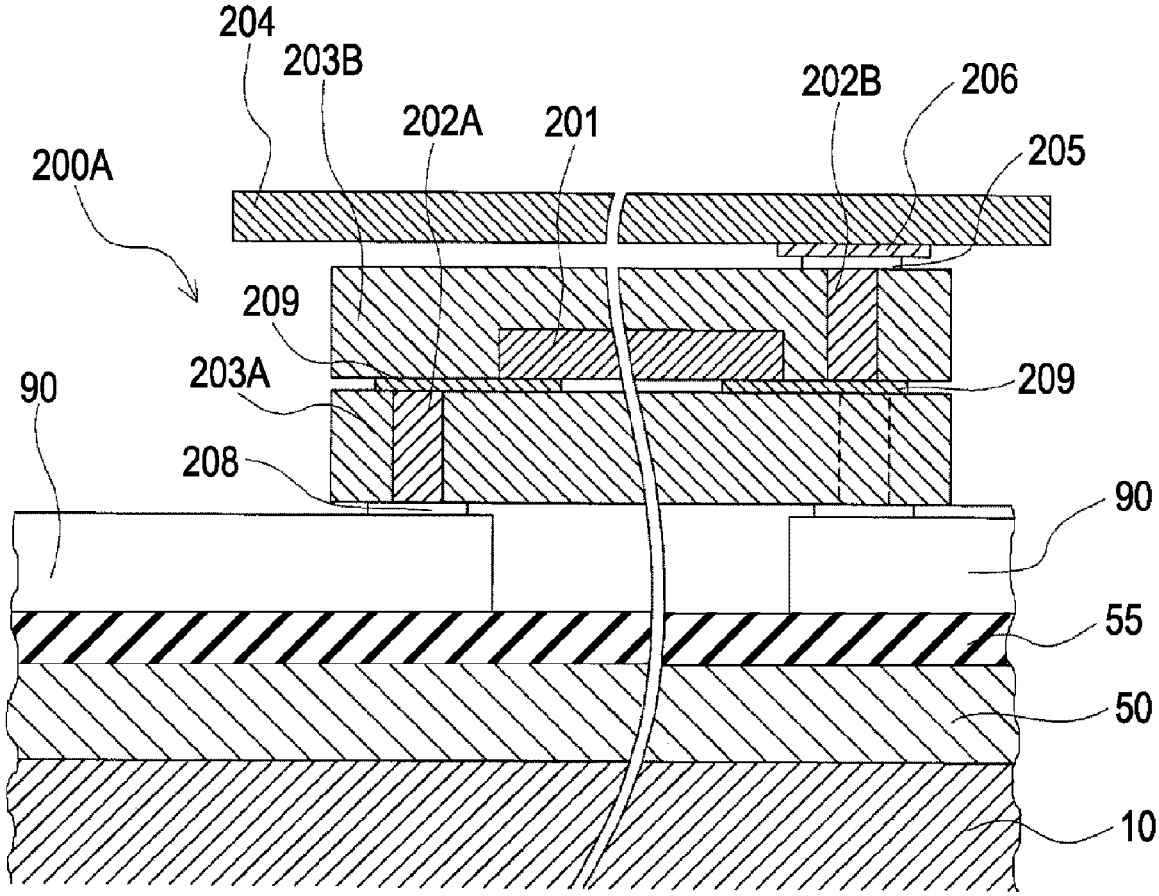
FIG. 5 is an enlarged cross-sectional view showing a modification of the recording head according to the second embodiment.

In this embodiment, while the driver circuit 201 is provided at the surface of the second semiconductor substrate 203B, i.e., at the surface opposite to a surface facing the first semiconductor substrate 203A, it is not limited thereto. For example, as shown in FIG. 5, the driver circuit 201 may be provided at the surface of the second semiconductor substrate 203B facing the first semiconductor substrate 203A. In such a case, the second pads 208, to which the individual lead electrodes 90 extending from the top electrode films 80 and the common lead electrodes 91 extending from the bottom electrode films 60 of the piezoelectric elements 300 are connected, may be connected to the driver circuit 201 via the first through electrodes 202A provided in the first semiconductor substrate 203A and via the intermediate wiring pattern 209. Also, the first pads 205, to which the external wiring pattern 204 is connected, may be connected to the driver circuit 201 via the second through electrodes 202B provided in the second semiconductor substrate 203B and via the intermediate wiring pattern 209.

While the IC chip has a laminated structure having the two semiconductor substrates in this embodiment, the IC chip may have a laminated structure having three or more semiconductor substrates.

Other Embodiment

Figure 6:
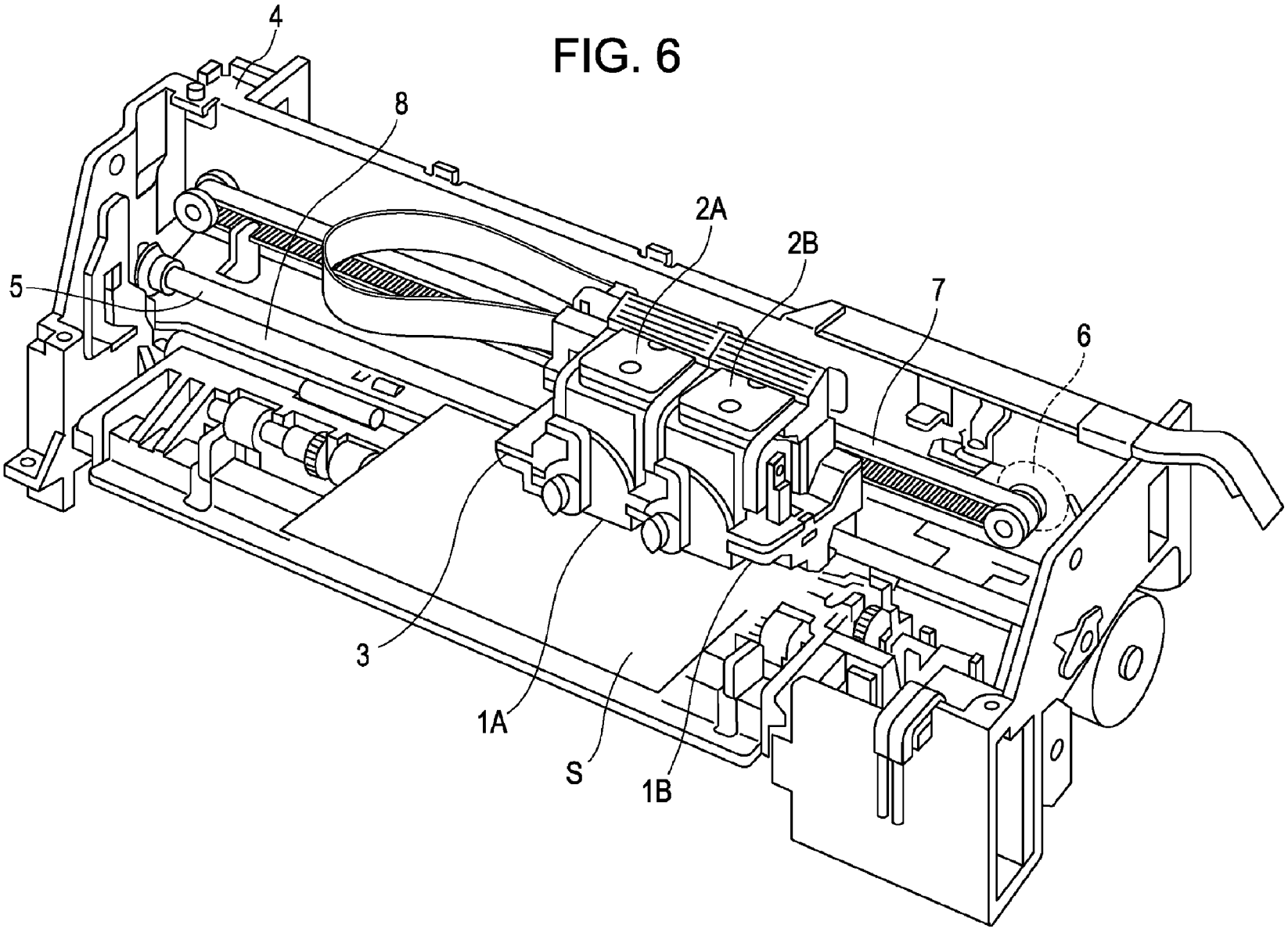
FIG. 6 is a schematic illustration showing a recording apparatus according to an embodiment.

The embodiments of the invention are described above, however, the basic structure of the ink jet recording head is not limited thereto. The ink jet recording head described in the embodiments is mounted in an ink jet recording apparatus as a portion of a recording head unit having an ink passage communicating with an ink cartridge and the like. FIG. 6 is a schematic illustration showing such an ink jet recording apparatus. As shown in FIG. 6, recording head units 1A and 1B have ink jet recording heads. Cartridges 2A and 2B (ink supplying units) are detachably attached to the recording head units 1A and 1B. The recording head units 1A and 1B are mounted in a cartridge 3. The cartridge 3 is provided at a carriage shaft 5 attached to an apparatus body 4, and is movable along the cartridge shaft 5. The recording head units 1A and 1B, for example, eject a black ink composition and a color ink composition. The driving force of a driving motor 6 is transmitted to the carriage 3 through a plurality of gears (not shown) and a timing belt 7. With this driving force, the carriage 3 having the recording head units 1A and 1B mounted thereon moves along the carriage shaft 5. Also, a platen 8 is provided at the apparatus body 4 along the carriage shaft 5. A recording sheet S, which is a recording medium such as paper, fed by a sheet-feeding roller (not shown) is transported over the platen 8.

While the above embodiment is described based on the ink jet recording head as a liquid ejecting head, the invention may be applied to a variety of liquid ejecting heads. The invention may be applied to a configuration for ejecting liquid other than ink. Examples of the liquid ejecting heads may include various recording heads used for image recording apparatuses such as printers; color material ejecting heads used for manufacturing color filters of liquid crystal displays etc.; electrode materials ejecting heads used for forming electrodes of organic electroluminescence (EL) displays, field emission displays (FEDs), etc.; and living organic material ejecting heads used for manufacturing biochips.

What is claimed is:

1. A liquid ejecting head comprising:

a passage-forming substrate having a nozzle opening, and a pressure-generating chamber communicating with the nozzle opening;

a plurality of pressure-generating elements provided on a surface of the passage-forming substrate with a diaphragm interposed therebetween, the pressure-generating elements having electrodes and causing pressure change in the pressure-generating chamber; and an IC chip mounted on the surface of the passage-forming substrate with the pressure-generating elements, the IC chip including a semiconductor substrate, a driver circuit provided at a surface of the semiconductor substrate, the driver circuit driving the pressure-generating elements, a first pad provided on a surface of the semiconductor substrate opposite to a surface facing the passage-forming substrate, the first pad being electrically connected to the driver circuit, an external wiring pattern electrically connected to the first pad, a second pad provided on the surface of the semiconductor substrate facing the passage-forming substrate, the second pad being electrically connected to the electrodes of the pressure-generating elements, and a through electrode penetrating through the semiconductor substrate, the through electrode being connected to the second pad, wherein the electrodes of the pressure-generating elements include individual electrodes, and at least the individual electrodes are electrically connected to the driver circuit via the through electrode.

2. The liquid ejecting head according to claim 1, wherein the IC chip is arranged such that a plurality of semiconductor substrates are laminated, each of the semiconductor substrates has the through electrode penetrating therethrough, and the through electrodes of the semiconductor substrates are connected to one another via an intermediate wiring pattern, the intermediate wiring pattern extending to a joint surface where the adjacent semiconductor substrates are bonded.

3. The liquid ejecting head according to claim 1, further comprising a joint substrate bonded to the surface of the passage-forming substrate with the pressure-generating element, wherein at least one of surfaces of a passage through which liquid is supplied is constituted by the joint substrate.

4. The liquid ejecting head according to claim 1, wherein the passage-forming substrate has a nozzle plate bonded thereon, the nozzle plate having the nozzle opening made by punching, and the passage-forming substrate and the nozzle plate are made of a silicon single crystal substrate.

5. The liquid ejecting head according to claim 1, wherein the through electrode is connected to lead electrodes extending from the electrodes of the pressure-generating elements.

6. The liquid ejecting head according to claim 5, wherein the electrodes of the pressure-generating elements include common electrodes, and the lead electrodes include common lead electrodes and individual lead electrodes, the common lead electrodes extending from the common electrodes of the pressure-generating elements, the individual lead electrodes extending from the individual electrodes of the pressure-generating elements, and the common lead electrodes and the individual lead electrodes are located at the same height in a region where the common lead electrodes and the individual lead electrodes are connected to the driver circuit.

7. A liquid ejecting apparatus comprising the liquid ejecting head described in claim 1.

* * * * *